United States Patent [19]

Hermkens

[11] Patent Number: 4,688,931

[45] Date of Patent: Aug. 25, 1987

[54] CONVEYOR SYSTEM FOR COPIER

[75] Inventor: Gerardus A. J. Hermkens, Herten, Netherlands

[73] Assignee: Oce-Nederland B.V., Netherlands

[21] Appl. No.: 780,319

[22] Filed: Sep. 26, 1985

[30] Foreign Application Priority Data

Sep. 27, 1984 [NL] Netherlands ..... 8402940

[51] Int. Cl.[4] ..... G03G 15/00

[52] U.S. Cl. ..... 355/3 SH; 355/14 SH; 271/208

[58] Field of Search ..... 355/3 SH, 14 SH, 3 R, 355/3 BE, 3 TR, 14 TR; 271/208, 6, 7, 18.1, 18.2

[56] References Cited

U.S. PATENT DOCUMENTS

| | | | |
|---|---|---|---|
| 4,435,067 | 3/1984 | Draai et al. | 355/3 TR |
| 4,518,976 | 5/1985 | Tarumi et al. | 355/3 TR X |
| 4,523,754 | 6/1985 | Hisajima et al. | 355/3 SH X |
| 4,531,825 | 7/1985 | Miwa et al. | 355/3 TR |

*Primary Examiner*—A. C. Prescott

*Attorney, Agent, or Firm*—Reed Smith

[57] ABSTRACT

A conveyor system is described, consisting of a pair of electrically conductive rollers about which an insulating belt is trained and a static-charge eliminator. The static charge of the belt and, thus, the conveyor system is reduced by providing the electrically conductive rollers with an insulating sleeve, guaranteeing the reliable transport of the document. The conveyor system may be used in a copier for moving originals onto a glass platen or copies through the toner transferring section.

10 Claims, 2 Drawing Figures

CONVEYOR SYSTEM FOR COPIER

BACKGROUND OF THE INVENTION

1. Field of the Invention

This invention relates to a conveyor system. More specifically, it relates to a conveyor system of a copier for moving documents onto the glass exposure platen or copies through a toner transfer station.

2. Description of the Prior Art

Conveyor systems of the kind described above are known. For example, *Xerox Disclosure Journal,* Volume 5, 1980, No. 4, page 369, discloses a typical conveyor system in which an insulating rubber belt is trained about two electrically conductive rollers. This system is secured a short distance above the glass exposure platen of a copying machine. A document feeder is provided to feed a document between the belt and the exposure platen. The belt conveys the document over the exposure platen, and after exposure it removes the document from the platen.

Tribo-electric charging of the insulating belt over the conductive rollers induces a charge on the platen so that the document sticks to the platen. Static charge eliminators are disposed near the belt to reduce this induced charge. *Xerox Disclosure Journal,* Volume 2, 1977, No. 6, page 81 shows a pin-type, corona-generating static charge eliminator. Although these static charge eliminators reduce the charge on the belt, the reduction is generally indadequate to guarantee reliable transport of the document. Thus, there is a need to provide a conveyor system which obviates this disadvantage and sufficiently reduces the static charge to guarantee reliable transport of the document.

U.S. Pat. No. 4,172,905 relates to a method of transferring images from one surface to another without the use of an insulating belt. That patent specifically teaches that a high level of charge is built up on an insulated roller which is not grounded. European patent application No. 0,118,137 relates to a device for transferring image information which uses electrically conductive rollers. Finally, U.S. Pat. No. 2,897,425 is directed to an apparatus for producing electrostatic force between a semiconductor and a conducting object wherein the endless belt must be made from a conducting material, either magnetic or nonmagnetic.

SUMMARY OF THE INVENTION

Generally, the present invention provides a conveyor system which guarantees the reliable transport of a document or a copy by adequately reducing static charge on the conveyor belt. The conveyor system comprises a plurality of electrically conductive rollers about which an insulating belt is trained, a drive means for the insulating belt, and at least one static charge eliminator disposed near the belt. The electrically conductive rollers of the conveyor system are provided with an insulating layer.

The conveyor system according to the present invention reduces static charge. Less charge is available to charge the insulating conveyor belt in a given time since the current through the insulating layer of the rollers is very small. Consequently, the one or more static charge eliminators are able to discharge the belt to a charge level which is a factor of from two to five times lower. This reduction in charge level is sufficient to guarantee an operationally reliable conveying system. Moreover, the life of the static charge eliminators will also increase as a result of the reduced charge on the belt.

Other advantages of the present invention will be apparent from a perusal of the detailed description of a preferred embodiment taken in connection with the accompanying drawings.

DESCRIPTION OF THE PREFERRED EMBODIMENTS

Figure 1:
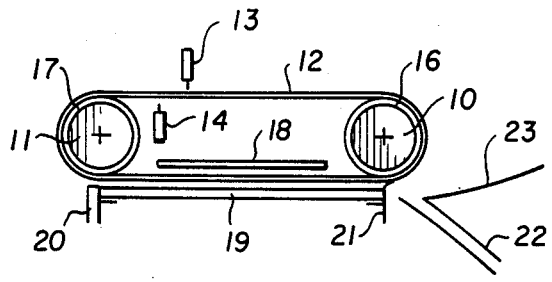
FIG. 1 is a conveyor system according to the invention.

In the conveyor system, as shown in FIG. 1, an insulating belt 12 of silicone rubber having a resistance of about $10^{13}$ Ohm.m is trained over electrically conductive rollers 10 and 11 which are both grounded. A conveyor means (not shown) can move belt 12 in both directions over an exposure platen 19, such as the glass exposure platen of a copying machine. Exposure platen 19 has a resistance of about $10^{11}$ Ohm.m and is grounded on two sides via strips 20 and 21.

An original document can be conveyed to exposure platen 19 via inlet path 22, whereupon belt 12 conveys the document onto exposure platen 19. Belt 12 is stopped when the original has arrived completely on exposure platen 19. After exposure, belt 12 is driven in the opposite direction so that the original is carried off exposure platen 19 via path 23.

Static charge eliminators 13 and 14 are disposed on either side of belt 12. They may be metal strips in the form of a comb which are grounded or they may be any other known device for discharging static electricity. Additionally, a grounded metal plate 18 is disposed between the rollers at a distance of about 1 mm from the belt.

An insulating sleeve 16 is disposed around roller 10 and an insulating sleeve 17 is disposed around roller 11. The insulating sleeves are made of polytetrafluoroethylene, i.e. Teflon. They are about 0.1 mm thick and have a resistance of about $10^{16}$ Ohm.m.

For the materials in the present invention, the following is the tribo-electric series: glass-metal-silicone rubber-Teflon. This means that when these substances come into contact with one another metal is charged negatively with respect to glass, silicone rubber somewhat more negatively with respect to glass, and Teflon the most negatively with respect to glass.

In the situation in which no insulating sleeve is provided around rollers 10 and 11, belt 12 receives a negative charge of about $16\times10^{-6}$ C/m$^2$. Since rollers 10 and 11 are grounded, a considerable current flows to insulating belt 12 so that the belt reaches its maximum charge in a very short time. The resulting potential of belt 12 with respect to static charge eliminators 13 and 14, which are at earth potential, is high and, therefore, a high discharge current will flow from belt 12 as a result of ionization of the air in the region of charge eliminators 13 and 14.

The high field strengths at the points of the static charge eliminators and the resulting high discharge currents also cause the points of static charge eliminators 13 and 14 to be attacked and rounded off. As a result, the life of the static charge eliminators is reduced. The remaining charge on belt 12 in the situation described is about 3 to $3\times10^{-6}$ C/m$^2$. This amount of charge has been found inadequate for reliable operation of the conveyor system.

If rollers 10 and 11, however, are provided with a 0.1 mm thick insulating layer of Teflon, the current flowing to the belt from the grounded rollers is small because of the high electrical resistance of Teflon. As a result, belt 12 charges up much more slowly than if no insulating layer is used. Static charge eliminators 13 and 14 are, thus, better able to discharge the smaller amounts of charge on belt 12. Also, the life of the static charge eliminators is increased because of the lower potential of the belt and because the discharge currents are less. In the preferred embodiment with the insulating layers of Teflon, the charge on belt 12 after discharge was only $1.6\times10^{-6}$ C/m$^2$. This charge is low enough for the conveyor system to operate without any difficulty.

The reduction in belt charge also causes the induced charge an exposure platen 19 to decrease. A further reduction of the charge induced in the exposure platen is achieved by means of a grounded metal plate 18 which causes the charge on the belt to be distributed between the exposure platen 19 and the metal plate 18.

In another embodiment of the conveyor system according to the invention, rollers 10 and 11 are provided with a silicone rubber insulating layer 16 and 17 respectively, instead of the Teflon layer. Again, the charge on belt 12 after discharge was found to have decreased to about $1.6\times10^{-6}$ C/m$^2$.

In the case of an insulating layer having a thickness of about 0.1 mm, the material forming the insulating layer must have a resistance of at least $10^{11}$ Ohm.m to obtain good operation of the conveyor system according to the invention.

Figure 2:
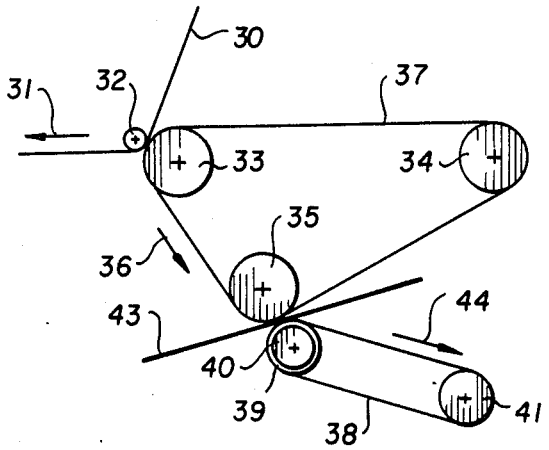
FIG. 2 is a conveyor system according to the invention for a toner transfer device.

FIG. 2 diagrammatically shows a conveyor system according to the invention used in the toner transfer device of a copier. An electrophotographic layer 30 on which an image of conductive toner is formed is fed between rollers 32 and 33 in the direction of arrow 31. There it is brought into contact with a first belt 37 of silicone rubber advancing in the direction of arrow 36 about rollers 33, 35, and 34. The inside of belt 37 is provided with a conductive carbon layer. The toner image is transferred from layer 30 onto belt 37. A second silicone rubber belt 38 is advanced about rollers 40 and 41 in the direction of arrow 44. The two belts 37 and 38 form a nip between rollers 35 and 40. The belts can be heated by any conventional heat sources, which are not shown in the drawings.

A sheet of receiving material 43 can be fed through the nip by any conventional means known to one skilled in the art. In the nip, the toner image will be transferred from belt 37 onto receiving material 43 and will be fixed thereon by the melting of the toner. When the two rollers 35 and 40 are grounded, there will be practically no tribo-electric charging of belts 37 and 38. Feeding a sheet of receiving material 43 through the nip causes belt 38 to become negatively charged by tribo-electric charging. This charging proceeds very rapidly because of grounded roller 40 and the direct contact between roller 40 and belt 38. The sheet of receiving material 43 is also very rapidly charged positively by tribo-electricity.

As a result of the melting toner layer, sheet 43 will initially be entrained with belt 37. The high positive charge formed by tribo-electricity in sheet 43 will also result in a high mirror-image charge being induced on belt 37 so that sheet 43 will stick firmly to belt 37.

If, however, roller 40 is provided with an insulating layer 39, the charging of belt 38 and, hence, the charging of the sheet of receiving material 43 will be blocked during the conveying of receiving material 43 through the nip. Thus, the charge on the sheet of receiving material 43 is considerably reduced. The inducement of mirror-image charges in belt 37 also decreases considerably so that the attraction between belt 37 and the sheet of receiving material 43 is so reduced that the sheet by its own stiffness detaches from belt 37 and can be conveyed further without difficulty.

Since the charge formed on belt 38 depends both upon the resistance of insulating layer 39 and the speed at which the belt is conveyed, one is able to adjust the value such that the sheet of receiving material 43 always detaches from belt 37.

While presently preferred embodiments of the invention have been described in particularity, the invention may be otherwise embodied within the scope of the appended claims.

What is claimed is:

1. A paper conveyor system, comprising a plurality of electrically conductive rollers about which an insulating paper conveying belt is trained, a drive means for the belt, at least one static charge eliminator disposed near the belt, and wherein the rollers are provided with an insulating layer.

2. A conveyor system as described in claim 1, wherein the belt and the insulating layer are made of the same material.

3. A conveyor system as described in claim 2, wherein the belt and the insulating layer are made from insulating silicone rubber.

4. A conveyor system as described in claim 1, wherein polytetrafluoroethylene is used as the insulating layer.

5. A conveyor system as described in claim 1, wherein silicone rubber is used as the insulating layer.

6. A conveyor system as described in claim 1, wherein the resistance of the insulating layer is greater than $1.0\times10^{11}$ Ohm.m.

7. A paper conveyor system for a toner transfer device, comprising a first insulating belt onto which a toner image can be transferred, a second insulating belt for conveying paper in linear contact with the first belt and forming a nip therewith, the second belt being trained over at least two rollers such that the roller bringing the second belt into contact with the first belt is electrically conductive and grounded, a drive means for the two belts, a means for feeding a sheet of receiving material through the nip and a heating means for heating at least one of the belts wherein the roller bringing the second belt into contact with the first belt is provided with an insulating sleeve.

8. A conveyor system as described in claim 7, wherein the resistance of the insulating sleeve is greater than $1.0\times10^{11}$ ohm.m. so that the electrostatic charge of the sheet of receiving material is reduced and the sheet is no longer attracted by the first belt.

9. A conveyor system as described in claim 8, wherein the thickness of the insulating sleeve is about 0.1 mm.

10. A conveyor system as described in claim 6, wherein the thickness of the insulating sleeve is about 0.1 mm.

* * * * *